US008226886B2

(12) United States Patent
Hanlon et al.

(10) Patent No.: US 8,226,886 B2
(45) Date of Patent: Jul. 24, 2012

(54) NICKEL-BASED SUPERALLOYS AND ARTICLES

(75) Inventors: Timothy Hanlon, Glenmont, NY (US); Richard DiDomizio, Scotia, NY (US); Michael Francis Henry, Ashland, MA (US); Akane Suzuki, Clifton Park, NY (US); Arthur Samuel Peck, Greenville, SC (US); Stephen Joseph Balsone, Greenville, SC (US)

(73) Assignee: General Electric Company, Niskayuna, NY (US)

( * ) Notice: Subject to any disclaimer, the term of this patent is extended or adjusted under 35 U.S.C. 154(b) by 271 days.

(21) Appl. No.: 12/551,294

(22) Filed: Aug. 31, 2009

(65) Prior Publication Data

US 2011/0052443 A1 Mar. 3, 2011

(51) Int. Cl.
*C22C 19/05* (2006.01)
*C22F 1/10* (2006.01)

(52) U.S. Cl. ..... 420/448; 148/555

(58) Field of Classification Search ..... 420/448; 148/555

See application file for complete search history.

(56) References Cited

U.S. PATENT DOCUMENTS

| | | | | |
|---|---|---|---|---|
| 4,169,742 | A * | 10/1979 | Wukusick et al. | 148/404 |
| 4,402,772 | A * | 9/1983 | Duhl et al. | 148/404 |
| 5,154,884 | A | 10/1992 | Wukusick et al. | |
| 5,156,528 | A * | 10/1992 | Bobo | 416/190 |
| 5,489,194 | A * | 2/1996 | Yoshinari et al. | 416/241 R |
| 6,051,083 | A | 4/2000 | Tamaki et al. | |
| 6,428,637 | B1 | 8/2002 | Wood et al. | |
| 6,908,518 | B2 | 6/2005 | Bouse et al. | |
| 2003/0041930 | A1 * | 3/2003 | DeLuca et al. | 148/556 |
| 2005/0069450 | A1 | 3/2005 | Jiang et al. | |
| 2005/0260346 | A1 * | 11/2005 | Heng et al. | 427/248.1 |

FOREIGN PATENT DOCUMENTS

WO 2008091377 A2 7/2008

* cited by examiner

*Primary Examiner* — Jessee R. Roe
(74) *Attorney, Agent, or Firm* — Paul J. DiConza

(57) ABSTRACT

Nickel based alloys are provided comprising from about 7.0 weight percent (wt %) to about 12.0 wt % chromium, from about 0.1 wt % to about 5 wt % molybdenum, from about 0.2 wt % to about 4.5 wt % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, up to about 1.0 wt % niobium, up to about 0.02 wt % boron, and up to about 0.1 wt % carbon, with the remainder being nickel and incidental impurities. The alloys may be cast, directionally solidified and heat treated to provide articles having a gamma prime fraction of greater than about 50%.

17 Claims, No Drawings

NICKEL-BASED SUPERALLOYS AND ARTICLES

BACKGROUND

The present disclosure relates to nickel-based alloys and articles based thereupon.

Gas turbine engines operate in extreme environments, exposing engine components, especially those in the turbine section, to high operating temperatures and stresses. Power turbine buckets (or blades) in particular, which may be up to, or over, about 36 inches long and weight up to, or over, about 40 pounds, require a balance of properties including, but not limited to, casting cracking resistance, tensile strength, ductility, creep resistance, oxidation resistance, hot corrosion resistance, low freckle susceptibility, sufficiently low density, reasonable cost, and a moderately large heat treatment window.

Superalloys have been used in these demanding applications because of their ability to maintain reasonably high strengths up to ~75% of their respective melting temperatures, in addition to having excellent environmental resistance. Nickel-based superalloys, in particular, have been used extensively throughout gas turbine engines, e.g., in turbine blade, nozzle, and shroud applications. However, conventional nickel-based superalloys used in latter stage bucket applications can be difficult to cast, resulting in low yield. The steady increase in gas turbine firing temperature requirements has historically relied upon improved mechanical and environmental material performance in these applications.

Directional solidification has been successfully employed to optimize creep and rupture behavior in nickel-based superalloy bucket applications. Preferentially orienting grains in the direction of the principal stress axis, which generally coincides with the longitudinal direction, provides a columnar grain structure, eliminating grain boundaries transverse to the growth direction. Such an orientation also provides a favorable modulus of elasticity in the longitudinal direction, beneficial to the fatigue performance of the part.

When compared with conventionally cast alloy articles, the application of the directional solidification process produces articles having significant improvements in strength, ductility, and resistance to thermal fatigue. However, reduced strength and ductility properties may still be seen in the transverse direction in such articles due to the presence of columnar grain boundaries. In efforts to improve the transverse grain boundary strength of such articles, additional alloying elements, e.g., hafnium, carbon, boron and zirconium, have been utilized. However, the addition of these elements, as well as others, can result in a depression in other desired properties, e.g., melting point, and so a compromise in the balance of properties has heretofore been required.

Thus, there remains a need for nickel based alloys that exhibit more, or substantially all, of the desirable properties for use in gas turbine engines, e.g., resistance to corrosion, oxidation and creep, as well as high temperature strength. It would further be desired if any alloys so provided would either comprise elements not substantially detrimental to the desired properties, or be processed in such a way that any detriment to the desired properties is minimized, or eliminated.

BRIEF DESCRIPTION

There are provided herein nickel-based alloys comprising from about 7.0 weight percent (wt %) to about 12.0 wt % chromium, from about 0.1 wt % to about 5 wt % molybdenum, from about 0.2 wt % to about 4.5 wt % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, up to about 1.0 wt % niobium, up to about 0.02 wt % boron, and up to about 0.1 wt % carbon, with the remainder being nickel and incidental impurities.

There are also provided herein nickel-based alloys comprising from about 9.0 wt % to about 11.0 wt % chromium, from about 0.5 wt % to about 3.0 wt % molybdenum, from about 0.5 wt % to about 3.5 wt % titanium, from about 4 wt % to about 6 wt % aluminum, from about 3.5 wt % to about 4.25 wt % cobalt, from about 6.0 wt % to about 9.0 wt % tungsten, from about 4.0 wt % to about 6.5 wt % tantalum, from about 0.05 wt % to about 0.5 wt % hafnium, up to about 1.0 wt % niobium, up to about 0.01 wt % boron, and up to about 0.07 wt % carbon, the balance being nickel and incidental impurities.

A cast article is also provided and in one embodiment is formed from a nickel based alloy comprising from about 7.0 weight percent (wt %) to about 12.0 wt % chromium, from about 0.1 wt % to about 5 wt % molybdenum, from about 0.2 wt % to about 4.5 wt % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, up to about 1.0 wt % niobium, up to about 0.02 wt % boron, and up to about 0.1 wt % carbon, with the remainder being nickel and incidental impurities. The cast article has a gamma prime fraction of greater than about 50%.

There is also provided a cast article formed from a nickel based alloy comprising from about 9.0 wt % to about 11.0 wt % chromium, from about 0.5 wt % to about 3.0 wt % molybdenum, from about 0.5 wt % to about 3.5 wt % titanium, from about 4 wt % to about 6 wt % aluminum, from about 3.5 wt % to about 4.25 wt % cobalt, from about 6.0 wt % to about 9.0 wt % tungsten, from about 4.0 wt % to about 6.5 wt % tantalum, from about 0.05 wt % to about 0.5 wt % hafnium, up to about 1.0 wt % niobium, up to about 0.01 wt % boron, and up to about 0.07 wt % carbon, the balance being nickel and incidental impurities. The cast article has a gamma prime fraction of greater than about 50%.

In an additional embodiment there is provided a method for providing a cast and heat treated article. The method comprises providing a nickel-based alloy comprising from about 7.0 weight percent (wt %) to about 12.0 wt % chromium, from about 0.1 wt % to about 5 wt % molybdenum, from about 0.2 wt % to about 4.5 wt % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, up to about 1.0 wt % niobium, up to about 0.02 wt % boron, and up to about 0.1 wt % carbon, with the remainder being nickel and incidental impurities. The alloy is melted and directionally solidified to produce the article, and the article is heat treated so that the article comprises a gamma prime fraction of greater than about 50%.

In an additional embodiment there is provided a method for providing a cast and heat treated article. The method comprises providing a nickel-based alloy comprising from about 9.0 wt % to about 11.0 wt % chromium, from about 0.5 wt % to about 3.0 wt % molybdenum, from about 0.5 wt % to about 3.5 wt % titanium, from about 4 wt % to about 6 wt % aluminum, from about 3.5 wt % to about 4.25 wt % cobalt, from about 6.0 wt % to about 9.0 wt % tungsten, from about 4.0 wt % to about 6.5 wt % tantalum, from about 0.05 wt % to about 0.5 wt % hafnium, up to about 1.0 wt % niobium, up to about 0.01 wt % boron, and up to about 0.07 wt % carbon, the balance being nickel and incidental impurities. The alloy is melted and directionally solidified to produce the article, and the article heat treated so that the article comprises a gamma prime fraction of greater than about 50%.

DETAILED DESCRIPTION

Unless defined otherwise, technical and scientific terms used herein have the same meaning as is commonly understood by one of skill in the art to which this invention belongs. The terms "first", "second", and the like, as used herein do not denote any order, quantity, or importance, but rather are used to distinguish one element from another. Also, the terms "a" and "an" do not denote a limitation of quantity, but rather denote the presence of at least one of the referenced item, and the terms "front", "back", "bottom", and/or "top", unless otherwise noted, are merely used for convenience of description, and are not limited to any one position or spatial orientation. If ranges are disclosed, the endpoints of all ranges directed to the same component or property are inclusive and independently combinable (e.g., ranges of "up to about 25 wt. %, or, more specifically, about 5 wt. % to about 20 wt. %," is inclusive of the endpoints and all intermediate values of the ranges of "about 5 wt. % to about 25 wt. %," etc.). The modifier "about" used in connection with a quantity is inclusive of the stated value and has the meaning dictated by the context (e.g., includes the degree of error associated with measurement of the particular quantity).

A nickel-based superalloy is provided herein comprising a unique combination of alloying elements that result in the alloy being particularly adapted for casting and directional solidification to provide articles, e.g., gas turbine buckets, having a combination of improved mechanical properties, as well as improved resistance to oxidation and hot corrosion. More particularly, articles formed from the superalloys described can exhibit improved casting cracking resistance and a greater heat treatment window as compared to conventional nickel-based superalloys, so that the cost of manufacture can be reduced and the yield of cast parts can be increased. Further, articles produced using the present superalloys may also exhibit increased strength, ductility and creep resistance as compared to conventional Ni-based superalloys, so that the articles may be used at higher operating temperatures, and/or have longer useful lives and/or, in the instance of turbine buckets, be provided at longer lengths to provide improved efficiency.

It is well known that alloying elements will typically partition between the phases of an alloy in a manner related to the bulk chemistry. A phase of an alloy is considered to be a homogeneous, physically and chemically distinct constituent that is separated from the remainder of the alloy by distinct bonding surfaces. The structure of the alloys, typical of nickel-based superalloys, comprises a major phase known as gamma, which is the matrix of the alloy and thus commonly referred to as the gamma matrix. Alloy structure also comprises a major precipitate phase within the gamma matrix, called the gamma prime precipitate phase, and minor amounts of carbides, oxides, and borides. The high temperature strength of a nickel based superalloy is thought to be related to the amount of gamma prime precipitate phase present, in addition to the solid solution strengthening of the gamma matrix.

The alloying elements partition between the phases with the most important being the partitioning between the gamma matrix and the gamma prime precipitate. An understanding of how the elements partition between phases is necessary in alloy design to permit calculation of several alloy characteristics of importance including the chemical composition of gamma, gamma prime, carbides, oxides, and borides; the amount of gamma prime present as gamma prime particles and as gamma-gamma prime eutectic; stability of the gamma phase; and atomic lattice mismatch between gamma and gamma prime.

An analysis of a number of superalloys has shown that among those alloying elements generally used in the development of nickel-based superalloys, elements partitioning to the gamma matrix and which act as gamma solid solution strengthening elements are chromium (Cr), cobalt (Co), molybdenum (Mo), tungsten (W), rhenium (Re), and iron (Fe). In general, the heavy (large atom) refractory elements such as rhenium, tungsten and molybdenum are the most effective strengtheners at high temperatures. Solid solution strengthening is desirably achieved without causing instability of the matrix structure. Instability, which can have adverse effects on alloy properties, results from the development of unwanted phases or precipitates at high temperatures. And so, such phases or precipitates are desirably avoided.

The second major strengthening mechanism recognized in nickel-based superalloys is precipitation hardening. The precipitate is formed within the gamma matrix and is known as gamma prime. Gamma prime is an ordered face-centered cubic compound, $Ni_3Al$, which is coherent with the nickel matrix. Elements that segregate preferentially to the gamma prime phase include aluminum (Al), titanium (Ti), tantalum (Ta), niobium (Nb), and vanadium (V).

The present nickel-based superalloys, in some embodiments, exhibit superior castability, high temperature strength and creep behavior, cyclic oxidation resistance, and hot corrosion resistance as compared to conventional nickel-based superalloys. The superalloys described are also adapted for casting, directional solidification and heat treatment to provide articles, e.g., gas turbine buckets, while retaining the basic properties of the superalloy.

The nickel-based alloy designed accordingly and disclosed herein comprises chromium, molybdenum, titanium, aluminum, cobalt, tungsten, tantalum, hafnium, niobium, boron, and carbon. The nickel-based alloy is devoid of rhenium, thereby providing cost savings. In one embodiment, the nickel-based superalloy comprises from about 7.0 weight percent (wt %) to about 12.0 wt % chromium, from about 0.1 wt % to about 5 wt % molybdenum, from about 0.2 wt % to about 4.5 wt % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, up to about 1.0 wt % niobium, up to about 0.02 wt % boron, and up to about 0.1 wt % carbon, with the remainder being nickel and incidental impurities.

In another embodiment, the nickel-based alloy comprises from about 8.5 wt % to about 11.0 wt % chromium, from about 0.5 wt % to about 3.0 wt % molybdenum, from about 0.5 wt % to about 3.5 wt % titanium, from about 4 wt % to about 6 wt % aluminum, from about 3.5 wt % to about 4.25 wt % cobalt, from about 6.0 wt % to about 9.0 wt % tungsten, from about 4.0 wt % to about 6.5 wt % tantalum, from about 0.05 wt % to about 0.5 wt % hafnium, up to about 1.0 wt % niobium, up to about 0.01 wt % boron, and up to about 0.07 wt % carbon, the balance being nickel and incidental impurities.

In some embodiments, the chromium content of the nickel-based alloy may desirably be between about 7 wt % to about 12 wt %, or from about 8.5 wt % to about 11 wt %. In some embodiments, a balance is desirably maintained between chromium and aluminum so that the alloy can exhibit both good oxidation and hot corrosion resistance. Data generated in the evaluation of certain alloys described herein showed that a narrow Cr:Al ratio of from about 1.5 to about 2.5 provided the balance of properties required. And so, an appropriate range for aluminum in certain alloys described can be from about 4 wt % to about 6 wt %.

The titanium content of certain of the alloys described herein may desirably be between about 0.2 wt % to about 4.5 wt %, or from about 0.5 wt % to about 3.5 wt %. Titanium is desirably present in the aforementioned amounts so that the Al:Ti ratio can be greater than about 1, or 2, or 3, or even greater than about 4.

Tungsten is a viable alloying element for high temperature strength, and can partition to either the gamma phase, or the gamma prime phase. Tungsten may be included in certain of the described alloys in amounts of from about 6.0 wt % to about 9.0 wt %.

Molybdenum can act like tungsten in certain of the inventive alloys, but has a lower density. Molybdenum can be detrimental to environmental resistance, although this can be minimized by balancing amounts of chromium. In some embodiments, where chromium is present at from about 7 wt % to about 12 wt %, or from about 8.5 wt % to about 11 wt %, molybdenum may desirably be included in amounts of from about 0.1 wt % to about 5 wt %, or from about 0.5 wt % to about 3.0 wt %, so that the added strength benefit is seen without a substantial detriment to environmental resistance.

Tantalum partitions like titanium in nickel-based alloys, partitioning almost entirely to the gamma prime phase. Tantalum can be preferred over titanium in some embodiments, since tantalum has a higher melting point than titanium, and thus may not depress the melting point of the alloy as much as a similar amount of titanium. However, tantalum is a heavy element having a much higher density than titanium and so by utilizing more titanium than tantalum, a lighter article can be provided. Bearing these considerations in mind, useful amounts of tantalum in certain embodiments of the described superalloys can be from about 4.0 wt % to about 6.5 wt %, based upon the total weight of the alloy.

Cobalt can raise the solid solubility temperature of gamma prime, thereby increasing the temperature capabilities of alloys in which it is included. Cobalt can also contribute to structural stability of the alloy by inhibiting sigma phase precipitation. For these reasons, among others, in certain embodiments, the alloys described herein may include from about 3.0 wt % to about 4.9 wt %, or from about 3.4 wt % to about 4.25 wt %, cobalt, based upon the total weight of the alloy.

Hafnium can be useful as a grain boundary strengthener and can provide increased resistance to oxidation. And so, in some embodiments, the alloys described herein include haffnium in amounts of up to about 1.0 wt %, or from about 0.05 wt % to about 0.5 wt % hafnium. In certain embodiments, the alloys further comprise niobium, in amounts of up to about 1 wt %.

The nickel-based alloy may be processed according to any existing method(s) to form components for a gas turbine engine, including, but not limited to, powder metallurgy processes (e.g., sintering, hot pressing, hot isostatic processing, hot vacuum compaction, and the like), ingot casting, followed by directional solidification, investment casting, ingot casting followed by thermo-mechanical treatment, near-net-shape casting, chemical vapor deposition, physical vapor deposition, combinations of these and the like.

In one manner of manufacturing a gas turbine airfoil from a nickel-based alloy as described, the desired components are provided in the form of powder particulates, either separately or as a mixture and heated to a temperature sufficient to melt the metal components, generally from about 1350° C. to about 1750° C. The molten metal is then poured into a mold in a casting process to produce the desired shape.

As mentioned above, any casting method may be utilized, e.g., ingot casting, investment casting, high gradient casting or near net shape casting. In embodiments wherein more complex parts are desirably produced, the molten metal may desirably be cast by an investment casting process which may generally be more suitable for the production of parts that cannot be produced by normal manufacturing techniques, such as turbine buckets, that have complex shapes, or turbine components that have to withstand high temperatures. In another embodiment, the molten metal may be cast into turbine components by an ingot casting process. The casting may be done using gravity, pressure, inert gas or vacuum conditions. In some embodiments, casting is done in a vacuum.

After casting, the melt in the mold may advantageously be directionally solidified. Directional solidification generally results in elongated grains in the direction of solidification, and thus, higher creep strength for the airfoil than an equiaxed casting, and is suitable for use in some embodiments. In particular, the present alloys may be formed into multi-grained directionally solidified components, designed to accommodate many grains across the cross-section of the part, at a much greater yield than conventional single crystal nickel-based superalloys. That is, although small components may typically be made as a single crystal, many of the larger components of gas turbine engines may be difficult to form as a true single crystal. And so, yield of these components in SC form may not be commercially useful. In contrast, the yield of a similarly sized multi-grained directionally solidified gas turbine component utilizing embodiments described herein, can be at least about 80%, or from about 80% to about 100%.

Following directional solidification, the castings are cooled, e.g., as by any conventional cooling method. The castings comprising the nickel-based alloy may then be optionally subjected to different heat treatments in order to optimize the strength as well as to increase creep resistance. Desirably, heat treatment will result in the casting having a gamma prime fraction of greater than about 50%, or even greater than about 60%. The heat treatment may generally include heating the casting in vacuum to a temperature of about 2260° F. to about 2400° F. for 2 to 4 hours. The casting may then be cooled by a furnace cool in vacuum, argon or helium at a cooling rate of about 15° F./minute to about 45° F./minute to 2050° F., followed by gas fan cooling in vacuum, argon or helium at about 100° F./minute to about 150° F./minute to 1200° F. or below. Once below 1200° F., the articles can be cooled to room temperature at any cooling rate.

In some embodiments, the castings may be subjected to an aging treatment. For example, the castings may undergo aging by heating under vacuum to 1975° F. for a period of 4 hours, furnace cooling to below 1200° F., heating to from about 1600° F. to about 1650° F. for 4 to 16 hours, followed by a furnace cool to room temperature.

The nickel-based alloys described herein may thus be processed into a variety of airfoils for large gas turbine engines. As mentioned above, the Ni-based alloys described here can exhibit improved casting cracking resistance and a larger heat treatment window than conventional nickel-based superalloys, e.g., Rene' N4, thereby reducing the cost of manufacture and increasing the yield of cast parts. Articles formed from the disclosed alloys may further exhibit increased strength, ductility, and creep resistance, as well as oxidation and hot corrosion resistance. As a result, such articles may be used at higher operating temperatures and/or exhibit longer useful lives than articles formed from conventional nickel-based alloys.

Examples of components or articles suitably formed from the alloys described herein include, but are not limited to buckets (or blades), non-rotating nozzles (or vanes), shrouds, combustors, and the like. Components/articles thought to find particular benefit in being formed from the alloys described herein include nozzles and buckets. The superalloy can be used with various thermal barrier coatings.

One exemplary method of making a cast and heat treated article such as a large power turbine bucket of a nickel-base superalloy of the present disclosure may generally proceed as follows. The desired component, e.g., a turbine bucket, may be directionally cast with the superalloy. The casting may then be subjected to a heat treatment, generally including heating the bucket in vacuum to a temperature of from about 2260° F. to about 2400° F. for 2 to 4 hours, so that the bucket has a gamma prime fraction of greater than about 50%, or even greater than 60%. The bucket may then be cooled by a furnace cool in vacuum, argon or helium at a cooling rate of about 15° F. to about 45° F./minute to about 2050° F., followed by gas fan cooling in vacuum, argon or helium at about 100° F./minute to about 150° F./minute to about 1200° F. or below. Once below about 1200° F., the bucket(s) can be cooled to room temperature at any cooling rate. The bucket(s) may then undergo aging by heating under vacuum to about 1975° F. for a period of 4 hours, furnace cooling to below about 1200° F., heating to from about 1600° F. to about 1650° F. for 4 to 16 hours, followed by a furnace cool to room temperature.

Although the superalloy of the present invention is ideally suited for directionally solidification casting, it can be readily produced by conventional casting or single crystal casting techniques. The superalloy is well suited for high temperature turbine components such as blades, buckets, vanes, and the like for gas turbine engines.

The following examples, which are meant to be exemplary and non-limiting, illustrate compositions and methods of manufacturing some of the various embodiments of the nickel-based alloys. In the following examples, test specimens were cast in a directional solidification furnace. The mold withdrawal rate, which corresponds to the solidification rate, was 12 inches per hour. Material properties were measured in the as-directionally solidified condition with the express intent of optimizing chemistry independent of heat treatment effects.

Example 1

In this example, forty unique nickel-base superalloys were directionally cast and evaluated. Key material attributes required for optimal gas turbine bucket performance were identified, prior to mechanical testing. Each attribute was assigned a weighting factor based on its relative importance. Calculated and measured properties were then merged to a common unitless scale, and weighted accordingly. The summation of the weighted, unitless attributes provided a means to rank alloys based on their total balance of properties. Table 1 indicates the chemistry of three exemplary alloys (Alloy 1, Alloy 2, and Alloy 3) by weight percent, with the balance being Ni and impurities. Each of these nickel-base superalloys had a predicted gamma prime mol fraction greater than 50%. Also included is a standard high temperature nickel base superalloy, Rene' N4, currently employed for the manufacture of high temperature turbine components.

TABLE I

| Alloy | Cr | B | C | Co | Al | Hf | Mo | Nb | Ta | Ti | W |
|---|---|---|---|---|---|---|---|---|---|---|---|
| *Rene' N4 | 9.75 | 0.004 | 0.05 | 7.50 | 4.20 | 0.15 | 1.50 | 0.50 | 4.80 | 3.50 | 6.00 |
| 1 | 9.59 | 0.01 | 0.07 | 3.93 | 4.13 | 0.15 | 0.74 | 0.49 | 5.90 | 3.44 | 8.85 |
| 2 | 9.78 | 0.01 | 0.04 | 4.01 | 4.71 | 0.15 | 1.50 | 0.50 | 6.01 | 2.62 | 6.02 |
| 3 | 10.00 | 0.01 | 0.05 | 4.10 | 5.80 | 0.50 | 2.50 | 0.00 | 4.45 | 0.82 | 7.97 |

Compositions are in weight percent, with the balance being Ni and impurities

*Comparative Example

Table II provides various calculated properties of the superalloy compositions. Each alloy is predicted to exhibit a heat treatment window similar to or greater than the reference alloy, Rene' N4, with improved processability and yield a likely consequence. The calculated density of each alloy is similarly aligned with the reference alloy. Predicted gamma prime mol fraction is higher in each case, relative to Rene' N4, which is typically desirable from a high temperature strength perspective.

TABLE II

| Alloy | Calculated Gamma Prime Solvus (° F.) | Calculated Incipient Melting Point (° F.) | Calculated Heat Treatment Window (° F.) | Calculated Density (lb/in$^3$) | Calculated Gamma Prime Max. NP (%) |
|---|---|---|---|---|---|
| *Rene' N4 | 2192 | 2351 | 159 | 0.298 | 69 |
| 1 | 2185 | 2352 | 167 | 0.302 | 72 |
| 2 | 2211 | 2355 | 144 | 0.299 | 73 |
| 3 | 2222 | 2381 | 159 | 0.298 | 76 |

*Comparative example

Table III summarizes various material properties measured in the as-directionally solidified (as-DS) condition, wherein the term "UTS" refers to ultimate tensile strength; and the term "YS" is yield strength.

Castability was analyzed by a casting cracking test in accordance with U.S. Pat. No. 4,169,742, wherein the total crack length was measured at the outer diameter of a directionally solidified thin wall casting (about 60 mils thick). Alloys exhibiting the least amount of cracking are preferred. Each alloy in Table III exhibits superior resistance to casting cracking, under the constraints of this screening experiment, relative to the reference alloy.

The creep behavior of each alloy was evaluated in air at 1400° F. and 1800° F. Dead weight loading was used to impose a stress of 107 ksi at 1400° F., and 31 ksi at 1800° F. Plastic strain was monitored throughout the duration of the test. Table III indicates improvements in the times to 2% creep, which range from 2.0× to 3.5× at 1400° F., relative to as-DS Rene' N4. Additionally, improvements in the times to 2% creep at 1800° F. are between 2.75× and 4.75×, relative to as-DS Rene' N4. Times to rupture at each temperature are also improved by similar orders of magnitude, relative to as-DS Rene' N4.

The tensile behavior of each material was evaluated in air at 1400° F. Specimens were pulled to failure at a fixed displacement rate of 0.02 inches/minute. Table III indicates a range of behavior, relative to the reference alloy. Alloys 1 and 2 exhibit considerable improvements in yield strength, with comparable ultimate tensile strengths. Alloy 3 measures slightly lower in yield and tensile strengths, relative to as-DS Rene' N4. It is effectively balanced, however, by its superior castability and creep behavior.

TABLE III

| As-DS Alloy | Measured Thin Wall Casting Total Crack Length (inches) | Measured Time to 2.0% Creep Strain (hours) 1400° F./ 107 ksi | Measured Time to 2.0% Creep Strain (hours) 1800° F./ 31 ksi | Measured Time to Rupture (hours) 1400° F./ 107 ksi | Measured Time to Rupture (hours) 1800° F./ 31 ksi | Tensile YS @ 1400° F. (ksi) | Tensile UTS @ 1400° F. (ksi) |
|---|---|---|---|---|---|---|---|
| *Rene' N4 | 17.4 | 23.0 | 14.6 | 95.7 | 25.4 | 146 | 168.6 |
| 1 | 13.6 | 82.0 | 69.4 | 133.2 | 104.9 | 154.6 | 166.7 |
| 2 | 9.1 | 47.0 | 61.5 | 105.2 | 87.9 | 153.5 | 169.6 |
| 3 | 7.8 | 61.0 | 40.1 | 142.4 | 64.0 | 131.2 | 153.8 |

*Comparative example

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A nickel-based alloy comprising from about 7.0 (wt %) to about 12.0 wt % chromium, from about 0.1 wt % to about 5 wt % molybdenum, from about 0.82 wt. % to about 4.5 wt. % titanium, from about 4 wt % to about 6 wt % aluminum, from about 3 wt % to about 4.9 wt % cobalt, from about 6.0 wt % to about 9.0 wt % tungsten, from about 4.0 wt % to about 6.5 wt % tantalum, from about 0.05 wt % to about 0.6 wt % hafnium, niobium present in an amount of up to about 1.0 wt %, boron present in an amount of up to about 0.02 wt %, and about 0.04 wt % to about 0.1 wt. % carbon, with the remainder being nickel and incidental impurities.

2. The nickel-based alloy of claim 1, wherein the alloy is substantially free of rhenium.

3. The nickel-based alloy of claim 1, wherein the alloy has an aluminum to titanium ratio of greater than about 1.

4. A cast article of the alloy of claim 1, having a gamma prime volume fraction of greater than about 50%.

5. The cast article of claim 4, having a gamma prime volume fraction of greater than about 60%.

6. The cast article of claim 4, comprising a component of a gas turbine engine.

7. The cast article of claim 6, wherein the component comprises a bucket.

8. The nickel-based alloy of claim 1 comprising about 9.59 wt % to about 9.78 wt % chromium, about 0.74 wt % to about 1.5 wt % molybdenum, about 0.82 wt. % to about 4.5 wt % Ti, about 4.13 wt % to about 4.71 wt % aluminum, about 3.93 wt % to about 4.01 wt % cobalt, about 6.02 wt % to about 8.85 wt % tungsten, about 5.90 wt % to about 6.01 wt % tantalum, about 0.15 wt % hafnium, about 0.50 wt % niobium, about 0.01 wt % boron, and about 0.04 wt. % carbon, with the remainder being nickel and incidental impurities.

9. The nickel-based alloy of claim 8 wherein titanium is present in an amount of about 2.62 wt. % to about 3.44 wt. %.

10. The nickel-based alloy of claim 1 wherein carbon is present in an amount of about 0.07 wt. % to about 0.1 wt. %.

11. A nickel-based alloy comprising from about 9.0 wt % to about 11.0 wt % chromium, from about 0.5 wt % to about 3.0 wt % molybdenum, from about 0.82 wt % to about 3.5 wt % titanium, from about 4 wt % to about 6 wt % aluminum, from about 3.5 wt % to about 4.25 wt % cobalt, from about 6.0 wt % to about 9.0 wt % tungsten, from about 4.0 wt % to about 6.5 wt % tantalum, from about 0.05 wt % to about 0.5 wt % hafnium, niobium present in an amount of up to about 1.0 wt %, boron present in an amount of up to about 0.01 wt %, about 0.04 wt % to about 0.1 wt. % carbon, with the remainder being nickel and incidental impurities.

12. The nickel-based alloy of claim 11, wherein the alloy is substantially free of rhenium.

13. The nickel-based alloy of claim 11, wherein the alloy has an aluminum to titanium ratio of greater than about 1.

14. A cast article of the alloy of claim 11, having a gamma prime volume fraction of greater than 50%.

15. The cast article of claim 14, having a gamma prime volume fraction of greater than about 60%.

16. The cast article of claim 14, comprising a component of a gas turbine engine.

17. The cast article of claim 16, wherein the component comprises a bucket.

* * * * *